United States Patent [19]

Logan, Jr.

[11] 4,134,613

[45] Jan. 16, 1979

[54] CONVERTIBLE FURNITURE STRUCTURE

[76] Inventor: Clifford K. Logan, Jr., 4865 N. Blackwelder, Oklahoma City, Okla. 73118

[21] Appl. No.: 802,364

[22] Filed: Jun. 2, 1977

[51] Int. Cl.[2] ..... A47C 17/14; A47C 13/00

[52] U.S. Cl. ..... 297/107; 5/18 R; 5/12 R

[58] Field of Search ..... 297/107, 112, 118; 5/12, 18, 13, 17

[56] References Cited

U.S. PATENT DOCUMENTS

| | | | |
|---|---|---|---|
| 2,703,411 | 3/1955 | Kelly | 297/107 |
| 3,167,788 | 2/1965 | Murphy et al. | 5/18 R X |
| 3,710,403 | 1/1973 | Weidner et al. | 5/18 R |
| 3,972,079 | 8/1976 | Shellow et al. | 297/107 X |

FOREIGN PATENT DOCUMENTS

| | | | |
|---|---|---|---|
| 242811 | 6/1946 | Switzerland | 297/107 |

*Primary Examiner*—Roy D. Frazier
*Assistant Examiner*—Peter A. Aschenbrenner
*Attorney, Agent, or Firm*—C. Clark Dougherty, Jr.

[57] ABSTRACT

A furniture structure which converts into a bed comprised of a pair of rectangular frame members, one slidably supported on top of the other, so that the top frame member can be moved relative to the bottom frame member from a position whereby the frame members are coincident to an expanded position whereby the top frame member has one end thereof supported on an end of the bottom frame member. A rectangular cushion is attached to the top frame member and a second rectangular cushion is removably positioned on top of the first cushion. The second cushion is of a thickness equal to the thickness of the first cushion plus the thickness of the top frame member whereby when the frame members are moved to the expanded position and the second cushion is disposed on the bottom frame member, the top surfaces of the cushions are positioned at equal heights above the floor.

1 Claim, 7 Drawing Figures

CONVERTIBLE FURNITURE STRUCTURE

BACKGROUND OF THE INVENTION

1. Field of the Invention

The present invention relates generally to a convertible furniture structure, and more particularly, but not by way of limitation, to a furniture structure having an expandible frame and a removable top cushion which converts to a bed.

2. Description of the Prior Art

A variety of convertible lounges, couches and other furniture structures have heretofore been developed. Such structures generally include a foldable or telescoping frame arranged in a manner such that the frame can be unfolded to form a flat support for a mattress positioned thereon or to otherwise form a bed. Because such structures are complex in design requiring a number of manufactured parts, they have heretofore been relatively expensive to manufacture.

By the present invention an improved furniture structure is provided including an expandible frame and cushion arrangement for conversion to a bed which is simple in design and economical to manufacture.

SUMMARY OF THE INVENTION

A convertible furniture structure comprised of a first rectangular frame adapted to be supported horizontally on the floor and a second frame slidably supported on top of the first frame. The second frame includes one or more legs attached thereto for supporting one end thereof above the floor whereby the second frame can be moved relative to the first frame from a position substantially coincident with the first frame to an expanded position whereby the end of the second frame opposite from said legs is supported on an end of the first frame. A first rectangular cushion is attached to the second frame and a second rectangular cushion is removably positioned on top of the first cushion. The second cushion is of a thickness equal to the thickness of the first cushion plus the thickness of the second frame whereby when the second frame is moved to the expanded position and the second cushion is disposed on the first frame, the top surfaces of the first and second cushions are positioned at equal heights above the floor.

It is, therefore, a general object of the present invention to provide a convertible furniture structure.

A further object of the present invention is the provision of an improved convertible furniture structure which is simple in design and economical to manufacture.

Other and further objects, features and advantages of the present invention will be readily apparent to those skilled in the art upon a review of the description of preferred embodiments which follows when taken in conjunction with the accompanying drawings.

DESCRIPTION OF PREFERRED EMBODIMENTS

The convertible furniture structure of the present invention can take a variety of specific forms and designs such as chairs, couches, lounges, ottomans, hassocks, etc. For purposes of this disclosure, an ottoman embodying the invention is described, but it is to be understood that the invention is not limited to an ottoman or other specific furniture form or design.

Figure 1:
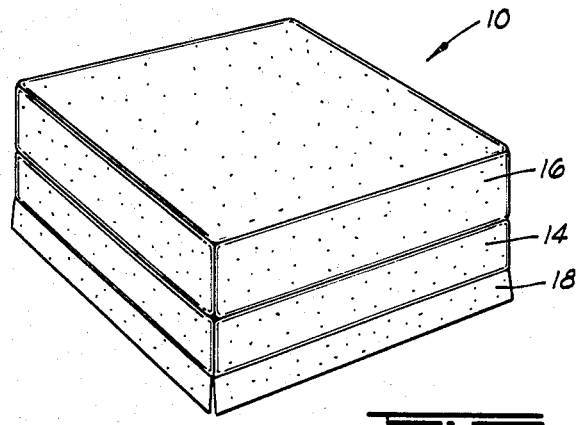
FIG. 1 is a perspective view of a convertible ottoman made in accordance with the present invention.
Figure 2:
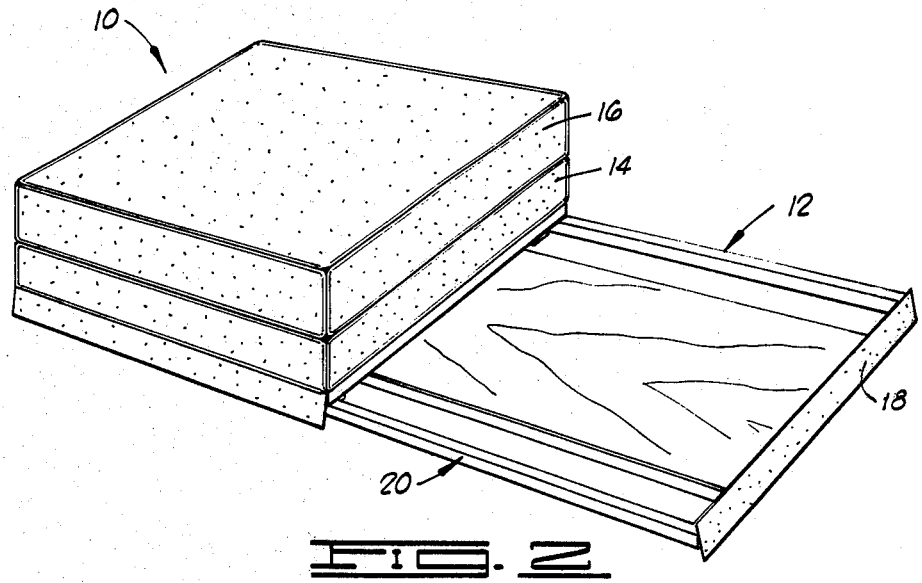
FIG. 2 is a perspective view similar to FIG. 1, but showing the frame of the ottoman in the expanded position.
Figure 3:
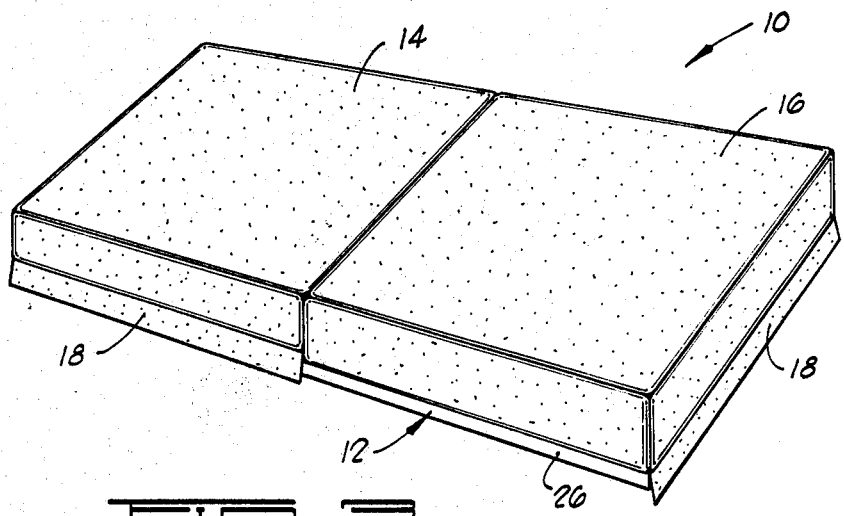
FIG. 3 is a perspective view similar to FIGS. 1 and 2, but showing the top cushion of the ottoman disposed on the expanded frame whereby a bed is formed therefrom.

Referring now to the drawings and particularly to FIGS. 1-3, a convertible ottoman embodying the present invention is illustrated and generally designated by the numeral 10. The ottoman 10 is comprised of an expandible rectangular frame assembly 12 having a first rectangular cushion 14 attached thereto and a second rectangular cushion 16 removably positioned on top of the first cushion 14. The usual skirt 18 is attached to the frame assembly 12. As shown in FIG. 2, the frame assembly 12 is expandible, i.e., a portion thereof can be moved outwardly to provide a horizontal surface for supporting the cushion 16, and as shown in FIG. 3, when the cushion 16 is placed on the expanded portion of the frame assembly 12, the ottoman 10 takes the form of a bed. As will be described further herein, the cushion 16 is of a greater thickness than the cushion 14 so that when the cushion 16 is placed on the expanded frame assembly 12, the top surfaces of the cushions 14 and 16 are positioned at equal heights above the floor.

Referring now to FIGS. 4-7, the frame assembly 12 of the ottoman 10 is illustrated in detail. The frame assembly 12 may be formed of wood or any other suitable material and is comprised of a first rectangular frame member 20 having a forward end 22 and a rearward end 24. The frame member 20 includes a pair of parallel side structural members 26 preferably rectangular in cross-section connected to a pair of identical parallel end structural members 28. A pair of structural members 30 are connected between the end members 28 interiorly of and parallel to the side members 26, and a flat sheet of material 32, such as plywood, is attached to the top of the frame member 20 whereby the area between the structural members 30 and end members 28 is covered by the material 32.

A second frame member 34 having a forward end 36 and a rearward end 38 is disposed on top of the frame member 20. The frame member 34 is formed of a pair of parallel side structural members 40 connected to a pair of parallel end members 42. The entire area defined by the sides 40 and ends 42 of the frame member 34 is covered by a flat sheet of material 44, and a pair of structural members 46 are connected between the ends 42 of the frame member 34 which are positioned interiorly of and parallel to the sides 40.

Figure 4:
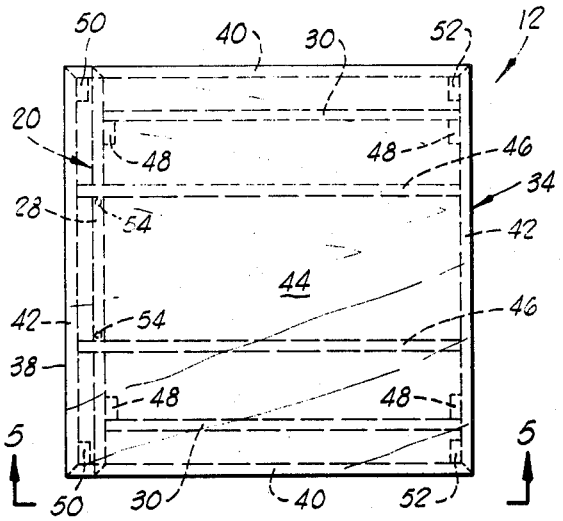
FIG. 4 is a top view of the frame assembly of the present invention in the folded or coincident position.
Figure 5:
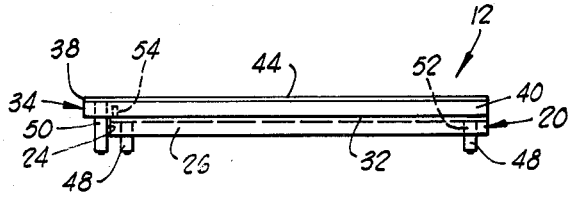
FIG. 5 is a side view taken along line 5—5 of FIG. 4.

Four legs 48 of equal length are attached to the frame member 20 adjacent the structural members 30 and ends 28 thereof for supporting the frame member 20 in a horizontal position above the floor. As best illustrated in FIGS. 4 and 5, when the frame assembly 12 is in the non-expanded position, i.e., the frame members 20 and 34 are substantially coincident, the frame member 34 is positioned on top of the frame member 20. The sides 40 of the frame member 34 are slightly longer than the sides 26 of the frame member 20 so that when in the coincident position, the end 38 of the frame member 34 overhangs the end 24 of the frame member 20. As will be understood, the end members 28 of the frame member 20 and end members 42 of the frame member 34 are of the same length so that the frame members 20 and 34 are of substantially the same size except for the slightly longer length of the sides 40 of the frame member 34 described above. A pair of legs 50 are attached to the overhanging rearward end 38 of the frame member 34, preferably at the connections of the sides 40 to the rearward end member 42 thereof. The legs 50 are of equal lengths greater than the lengths of the legs 48 so that when the frame members 20 and 34 are positioned coincidentally, the legs 50 reach the floor and support the rearward end 38 of the frame member 34.

Figure 6:
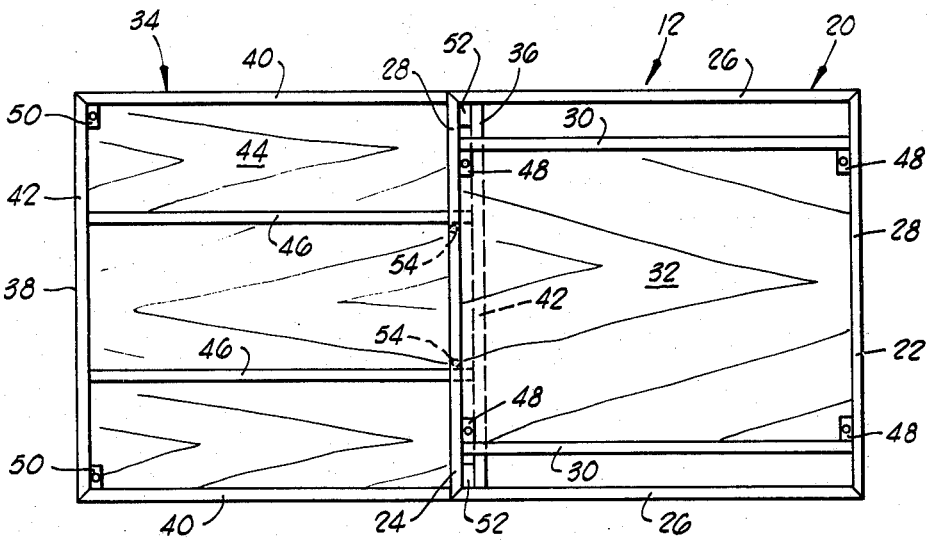
FIG. 6 is a bottom view of the frame assembly of the present invention in the expanded position.
Figure 7:
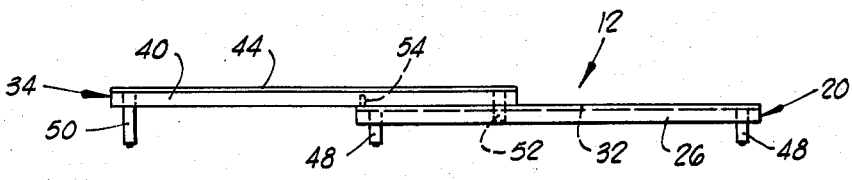
FIG. 7 is a side view of the frame assembly of the present invention in a partially expanded position.

As will now be readily apparent, the frame assembly 12 is expanded by moving the frame member 34 relative to the frame member 20 from a position whereby the frame members 20 and 34 are positioned coincidentally as illustrated in FIGS. 4 and 5, to an expanded position as illustrated in FIG. 6. FIG. 7 illustrates the frame assembly 12 in a partially expanded position. As will be further apparent, when the frame assembly 12 is expanded, the forward end 36 of the frame member 34 is supported on the rearward end 24 of the frame member 20, and the rearward end 38 of the frame member 34 is supported by the legs 50 attached thereto.

In order to maintain the frame members 20 and 34 of the frame assembly 12 in alignment when being moved from the coincident to the expanded positions, and in order to prevent the frame member 34 from being moved too far in either the forward or rearward directions relative to the frame member 20, a pair of downwardly extending posts 52 are attached to the forward end 36 of the frame member 34. The posts 52 extend within the interior of the frame member 20 adjacent the sides 26 thereof so that when in the coincident position, the posts 52 contact the forward end member 28 of the frame member 20 thereby preventing the frame member 34 from being moved to a position too far forward on the frame member 20, and when in the expanded position, the posts 52 contact the rearward end member 28 of the frame member 20 thereby preventing the frame member 34 from being moved too far rearwardly with respect to the frame member 20 and preventing the disengagemember of the frame members 20 and 34 from each other. As the frame member 34 is moved relative to the frame member 20, the posts 52 also slidably contact the insides of the sides 26 of the frame member 20 thereby maintaining the frame members 20 and 34 in alignment with each other.

In order to facilitate the maintenance of the frame members 20 and 34 in alignment and to prevent twisting of the frame member 34 with respect to the frame member 20 when being moved, a pair of upwardly extending guide posts 54 are attached to the rearward end member 28 of the frame member 20. The upwardly extending posts 54 are positioned adjacent the parallel structural members 46 of the frame member 34 so that they slidably contact side surfaces of the structural members 46 as the frame members 20 and 34 are moved relative to each other thereby preventing twisting of the frame member 34 with respect to the frame member 20. As illustrated in FIGS. 1–3, a portion of the skirt 18 is attached to the forward end member 28 of the frame member 20 with the remaining portions of the skirt 18 being attached to the sides 40 and rearward end member 38 of the frame member 34 thereby forming a continuous skirt around the ottoman 10 when the frame assembly 12 is not extended.

As illustrated in FIGS. 1, 4 and 5, when the ottoman 10 is utilized as an ottoman, the frame members 20 and 34 of the frame assembly 12 are positioned coincidentally and the cushion 16 is placed on top of the cushion 14. As illustrated in FIG. 2, 3 and 6, when it is desired to convert the ottoman 10 to a bed, the frame member 34 having the cushion 14 attached thereto is moved rearwardly whereby the frame member 20 is extended, and the cushion 16 is placed on the frame member 20. So that the top surfaces of the cushions 14 and 16 are of equal height, the thickness of the cushion 16 is equal to the thickness of the cushion 14 plus the thickness of the frame member 34.

As mentioned above, the furniture structure of the present invention can take a variety of forms and designs. For example, instead of an ottoman, the furniture structure can take the form of a couch or lounge. In this form, the end structural members 28 and 42 of the frame members 20 and 34 are elongated as compared to the structural members 26, 30, 40 and 46 thereof, as are the cushions 14 and 16. In addition, a back rest cushion can be utilized on top of the cushion 16, and if desired, arms formed of wood or other material can be attached to the frame member 34 for supporting the back rest cushion.

Thus, the present invention is well adapted to carry out the objects mentioned as well as others inherent therein. While presently preferred embodiments of the invention have been described for purposes of this disclosure, numerous changes in the construction and arrangement of parts can be made by those skilled in the art, which changes are encompassed within the spirit of this invention as defined by the appended claims.

What is claimed is:

1. A convertible furniture sturcture which comprises:

a first frame member adapted to be supported horizontally on the floor, said first frame member having forward and rearward ends connected in spaced relation by parallel side structural members;

a second frame member slidably supported on top of said first frame member, said second frame member including:

forward and rearward ends connnected in spaced relation by parallel side structural members;

a leg attached thereto for supporting one end thereof above the floor so that said second frame member can be moved relative to said first frame member from a position substantially coincident with said first frame member to an expanded position whereby the end of said second frame member opposite said leg is supported on an end of said first frame member; and a structural member connected between said forward and rearward ends of said second frame member and parallel to said parallel side structural members of said second frame member;

a first rectangular cushion attached to said second frame member;

a second rectangular cushion removably positioned on top of said first cushion, said second cushion having a thickness equal to the thickness of said first cushion plus the thickness of said second frame member whereby when said second frame member is moved to said expanded position and said second cushion is disposed on said first frame member, the top surfaces of said first and second cushions are positioned at equal heights above the floor;

means for stopping said first and second frame members after relative movement between said coincident and expanded positions, said stop means including a downwardly extending post attached to said second frame member at the end thereof opposite said leg positioned to extend into the interior of said first frame member whereby as said second frame member is moved relative to said first frame member between said coincident and expanded positions, said downwardly extending post contacts the ends of said first frame member and limits the movement of said second frame member with respect thereto; and means for guiding said first and second frame members during relative movement between said coincident and expanded positions, said guide means including an upwardly extending post attached to said first frame member at said rearward end thereof positioned to extend into the interior of said second frame member adjacent said structural member connected between said forward and rearward ends of said second frame member which structural member is parallel to said parallel side structural members of said second frame member, whereby as said first frame member is moved relative to said second frame member between said coincident and expanded positions, said upwardly extending post contacts said second frame member and limits the movement of said first frame member with respect thereto.

* * * * *